United States Patent [19]

Hampson et al.

[11] Patent Number: 4,653,627

[45] Date of Patent: Mar. 31, 1987

[54] REVERSE VENDING MACHINE

[75] Inventors: Alfred A. Hampson; Blair M. Hampson; Stuart R. Aldrich; Lyndon J. Robie, all of Portland, Oreg.

[73] Assignee: Can and Bottle Systems, Inc., Portland, Oreg.

[21] Appl. No.: 769,462

[22] Filed: Aug. 26, 1985

[51] Int. Cl.[4] ..... G07F 1/06

[52] U.S. Cl. ..... 194/209; 194/213; 194/216; 198/577; 198/397; 198/444; 100/902

[58] Field of Search ..... 194/205, 208, 209, 212, 194/213, 215, 216; 198/397, 443, 444, 577; 100/902

[56] References Cited

U.S. PATENT DOCUMENTS

| | | | |
|---|---|---|---|
| 3,249,203 | 5/1966 | Aidlin | 198/397 |
| 3,556,282 | 1/1971 | Moeltzner | 198/397 |
| 3,635,325 | 1/1972 | Sterling | 198/397 |
| 3,690,437 | 9/1972 | Kammann | 198/397 |
| 3,792,765 | 2/1974 | Arp | 194/209 |
| 4,069,928 | 1/1978 | Teske et al. | 198/598 X |
| 4,241,821 | 12/1980 | Wu et al. | 194/209 |
| 4,345,679 | 8/1982 | DeWoolfson | 194/209 |
| 4,480,737 | 11/1984 | Jamgochian et al. | 194/213 |
| 4,505,370 | 3/1985 | Swenck | 194/213 |
| 4,512,253 | 4/1985 | La Barge et al. | 194/212 X |
| 4,561,351 | 12/1985 | Ader | 100/902 X |

*Primary Examiner*—F. J. Bartuska
*Assistant Examiner*—Jay I. Alexander
*Attorney, Agent, or Firm*—Kolisch, Hartwell & Dickinson

[57] ABSTRACT

A reverse vending machine provides for the separation, counting and crushing of beverage containers of a predetermined size range and composition. The machine includes an in-feed station for receiving multiple, disarrayed containers, an on-load station, and an in-feed conveyor operable to transport multiple, disarrayed containers from the in-feed station to the on-load station. A separator/conveyor is provided for separating, singularly, a container from the disarrayed containers, and for transporting a container so separated from the on-load station to the off-load station. Mechanisms are provided to reject unacceptable containers between the on-load station and the off-load station. A counter is provided for counting the number of acceptable containers. The containers pass into a crusher which reduces the volume of the containers. A receipt printer is provided to print a receipt indicating the number of acceptable containers processed by the machine. A microprocessor coordinates machine operating cycles.

14 Claims, 4 Drawing Figures

REVERSE VENDING MACHINE

BACKGROUND AND SUMMARY OF THE INVENTION

The instant invention relates to the recycling of metals. Specifically, the reverse vending machine of the instant invention is constructed to recycle aluminum containers, primarily in those areas which do not have "bottle-bill" laws requiring mandatory redemption of beverage containers.

The recycling of used metal containers, specifically aluminum containers, has been repeatedly demonstrated to save approximately two-thirds the cost of raw materails for making such containers. Although many volunteer efforts are in place, and although many commercial recycling enterprises are in operation, the bulk of recyclable aluminum still remains unrecycled. This situation is the result of the absence of a labor-efficient means for recycling aluminum. Known recycling methods are labor intensive.

An object of the instant invention is to provide a machine for efficiently disposing of aluminum containers.

A further object of the invention is to provide a machine for disposing efficiently of aluminum containers which are non-redeemable, i.e., not part of a "bottle-bill" system.

Another object is to provide a machine for automatically counting recyclable beverage containers.

Yet another object of the instant invention is to provide a machine for crushing the containers so counted.

Still another object of the invention is to provide a machine for rejecting and disposing of unacceptable containers.

A further object is to provide a machine for printing a receipt representative of the number of acceptable containers deposited in the machine.

Yet another object of the invention is to provide a machine for recycling containers, which machine does not require frequent intervention of human labor.

Still a further object is to provide a machine for recycling aluminum containers, which machine is easy and cost effective to manufacture, and which occupies little space in a retail outlet or other location.

The reverse vending machine of the instant invention provides means for separating, counting and crushing beverage containers of a predetermined size range and includes an in-feed station for receiving multiple, disarrayed containers, an on-load station, and an in-feed conveyor operable to transport multiple, disarrayed containers from the in-feed station to the on-load station. A separator/conveyor is provided for separating, singularly, a container from the disarrayed containers and for transporting a container so separated from the on-load station to the off-load station. Interposed the on-load station and the off-load station are unacceptable container rejection devices, and a counter for counting acceptable containers. A crusher is located adjacent the off-load station for crushing containers. A receipt printer is provided for printing a receipt indicating the number of containers counted by the counter. A control system coordinates machine operating cycles.

These and other objects and advantages of the instant invention will become more fully apparent as the description which follows is read in conjunction with the drawings.

DETAILED DESCRIPTION OF A PREFERRED EMBODIMENT

Figure 1:
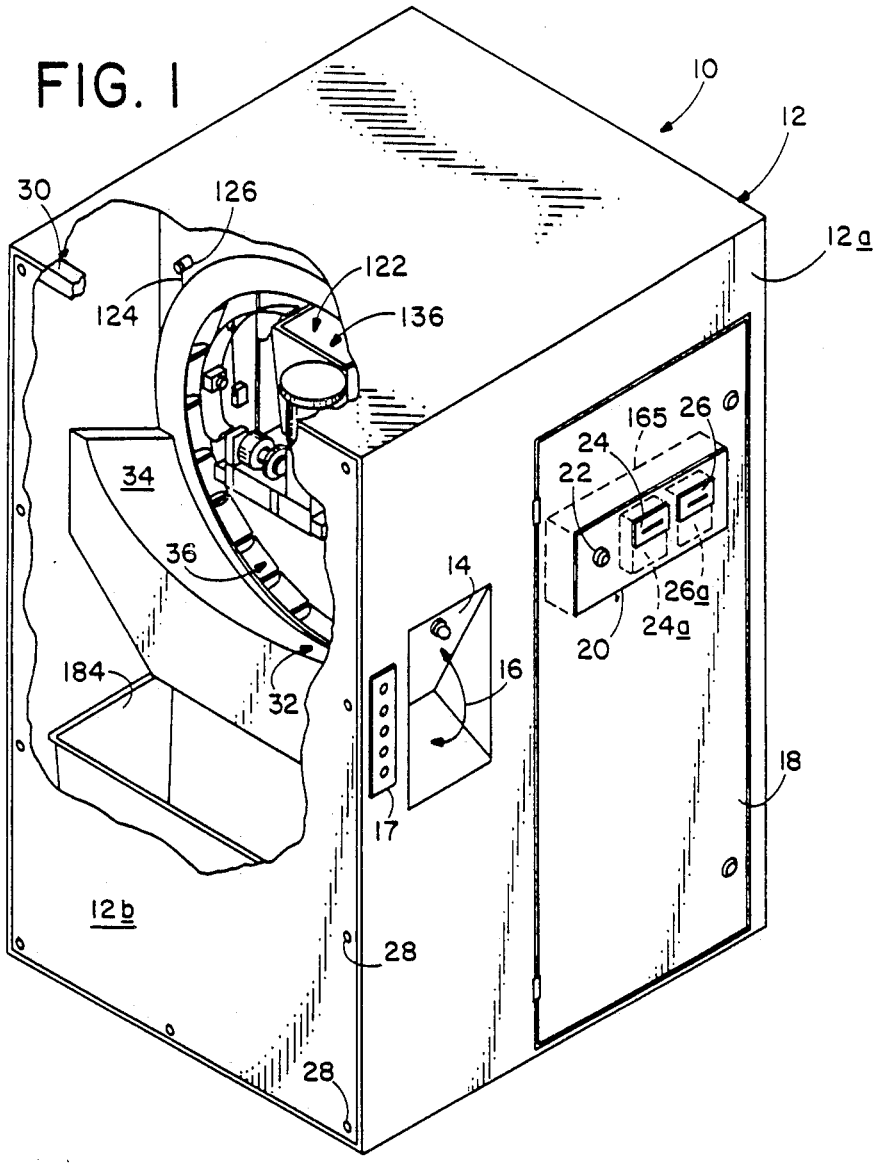
FIG. 1 is a perspective view of a reverse vending machine constructed according to the instant invention, with a portion broken away to illustrate interior construction.

Turning now to the drawings, and initially to FIG. 1, a reverse vending machine constructed according to the instant invention is shown generally at 10. Machine 10, in the preferred embodiment, includes a substantially rectangular cabinet 12 having two doors on its front side 12*a*. A door 14, allowing access to an in-feed station, is hinged for movement in the direction indicated by arrow 16. A light panel 17 indicates machine operating status. A door 18 allows access to the interior of cabinet 12. Door 18 has a control panel 20 which has thereon a starter button 22, a receipt output 24 and a coupon output 26.

The left side panel 12*b* of cabinet 12 is removable, and has a number of bolts 28 which are used to secure side 12*b* to a cabinet frame, partially shown at 30.

An in-feed station 32 is shown adjacent door 14. An infeed conveyor, or bin, 34 is operable to transport containers from in-feed station 32 to an on-load station, shown generally at 36.

Figure 2:
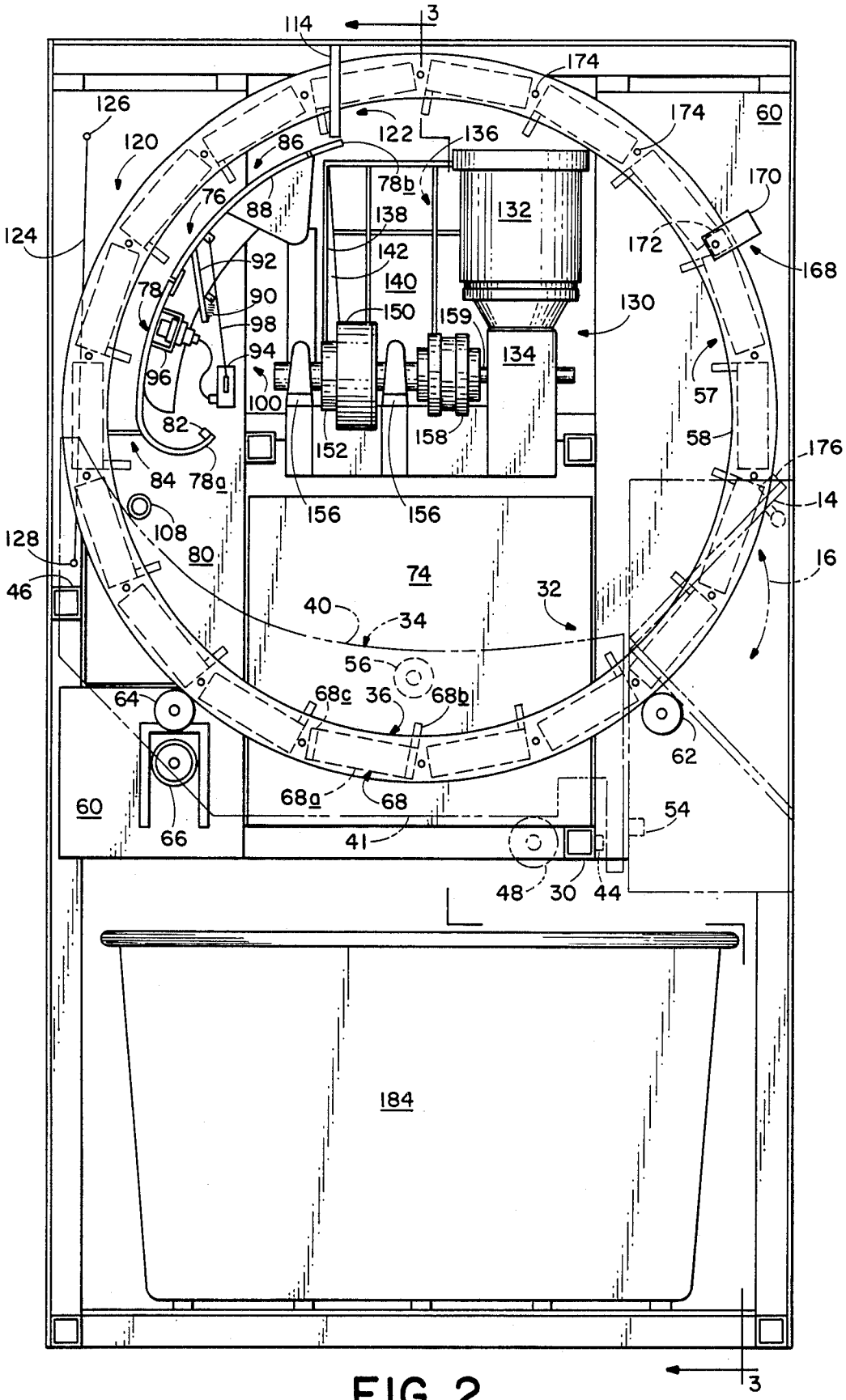
FIG. 2 is a side view of the machine of FIG. 1, with a side panel removed to show interior detail.
Figure 3:
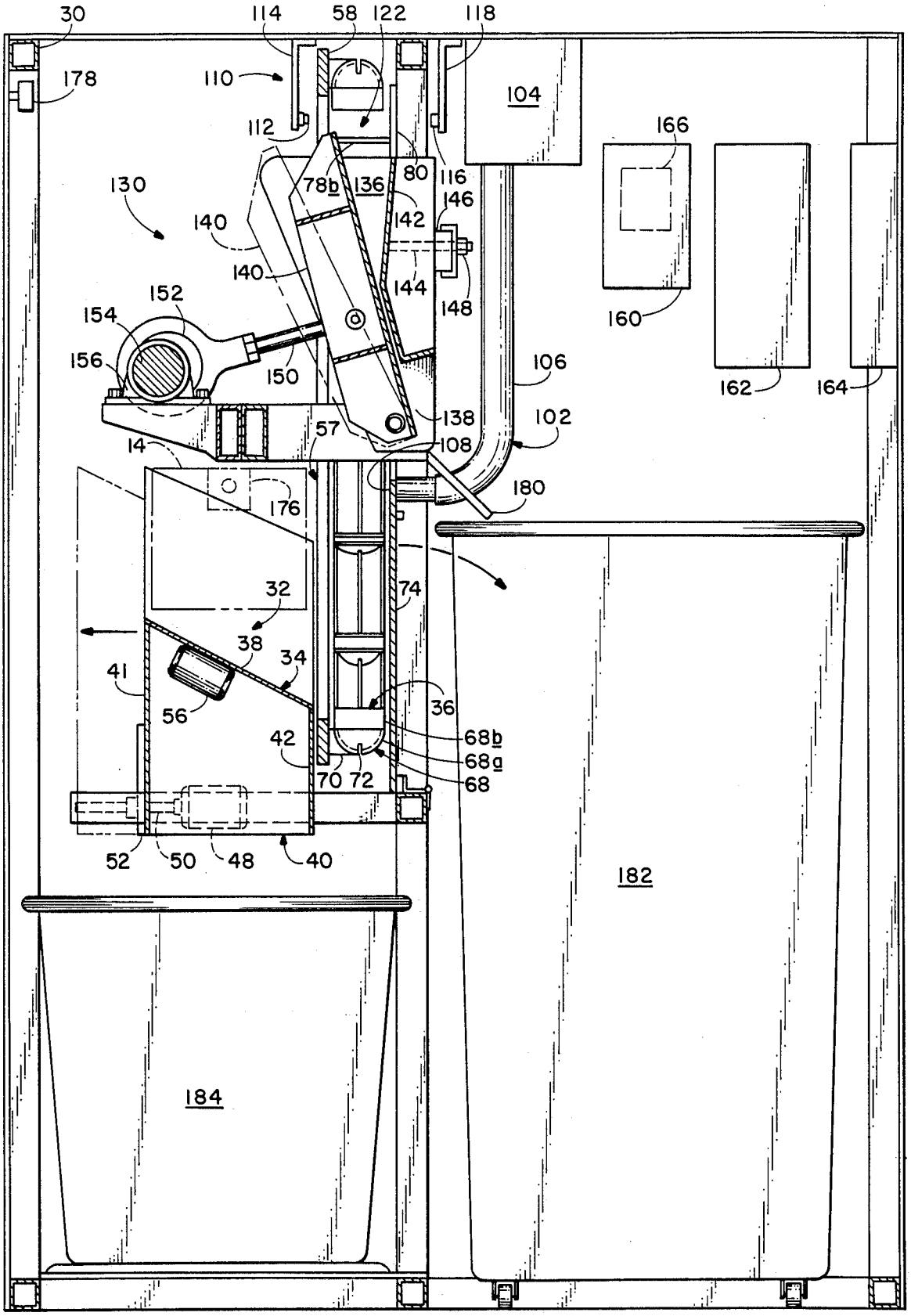
FIG. 3 is a sectional view taken generally along the line 3—3 in FIG. 2.

Referring now to FIGS. 2 and 3, bin 34 includes an inclined platform 38 which is mounted on a frame 40. Frame 40 has first side 41 which has an arcuate upper edge that joins with platform 38. A second side 42 of frame 40 is located adjacent on-load station 36, and also has an arcuate upper edge which is joined to platform 38. Bin 34 is mounted for movement on a pair of tracks, 44, 46. Tracks 44, 46 allow for the shifting of bin 34 from an operating position (solid lines in FIG. 3) to a transfer position (phantom lines in FIG. 3).

A reversible bin-position motor 48 is operable to shift the bin between the operating position and the transfer position. Motor 48 has a threaded shaft 50 which cooperates with a threaded bracket 52 which is fixed to side 41, to accomplish such shifting. A bin position sensor, shown schematically at 54, is mounted adjacent bin 34 for detecting whether the bin is in its operating or transfer position.

A vibrator 56 is mounted on the lower side of platform 38, and is operable to facilitate transfer of containers between in-feed station 32 and on-load station 36. Operation of vibrator 56 causes containers in bin 34 to shake. Gravity causes the shaken containers to move downhill, to station 36.

Separator/conveyor means is shown generally at 57, and, in the preferred embodiment, includes a circular frame 58 which is mounted for rotation on a central divider panel 60. Frame 58 is rotatably mounted on a pair of V-groove wheels 62, 64. Wheel 64 is powered by a reversible motor 66 which is mounted on divider 60.

Frame 58 has mounted thereon plural container carrying elements, such as that shown at 68. Each element, in the preferred embodiment, has a semi-cylindrical portion 68a which is substantially conformal with the containers to be carried therein. End plates 68*b*, 68*c*, are located at each end of portion 68*a*. At least one of the end plates, such as plate 68*b* in the preferred embodiment, projects beyond the planar edge of portion 68*a*.

Referring now to FIG. 3, each element is mounted on frame 58 by means of a bracket 70. Each element has a slot 72 cut in the curved wall of portion 68*a* which extends partially through plates 68*b*, 68*c*. Elements 68 are sized to receive standard size containers of a desired metallic composition. In the preferred embodiment, each element is sized to receive a standard size aluminum beverage container, no larger than 16 ounces.

A hinged panel 74 is provided in divider 60 to prevent containers from slipping past on-load station 36, and to allow access to the inner working of the machine.

Referring now to FIG. 2, container retention means are provided to hold containers in the container carrying elements. In the preferred embodiment, container retention means 76 takes the form of a guide, or guide means, 78 which is a strip of resilient material secured to a guide means panel 80. One end 78*a* of guide 78 is held in a curved form by means of a bracket 82. End 78*a*, in cooperation with panel 80 and conveyor 57, forms a funneling area, depicted generally at 84.

Port means 86 include a flexible, hinged flap 88 that is formed in guide 78 to allow passage of unacceptable containers therethrough. Flap 88 is biased to a closed position by spring 90 and bracket 92.

A solenoid 94 is operable with a metal detector 96 and a connector 98 to open flap 88 if a ferrous-metal can should be placed in machine 10 and come adjacent detector 96. Solenoid 94, detector 96, connector 98 and flap 88 comprise what is referred to herein as ferrous-metal can reject means, and is identified generally by 100.

Guide 78 and flap 88 are constructed of suitable material to allow flap 88 to yield a predetermined amount when pressure is placed thereon by a container in excess of a predetermined weight, such as would occur if a can which was not completely empty were introduced into the machine or if a glass container were placed into the machine. Tension on spring 90 may be varied to adjust the amount of weight required to deform flap 88. Flap 88, spring 90 and bracket 92 comprise what is referred to herein as overweight container rejection means.

Referring now to FIGS. 2 and 3, load control means 102 are provided to prevent the conveying of more than one container in an individual element 68, and is another component of the separator/conveyor means. In the preferred embodiment, load control means includes a compressor 104 which provides a high-pressure fluid stream to a duct 106 which is connected to a nozzle 108. Nozzle 108 is also referred to herein as means for directing a fluid stream towards the container carrying elements. Nozzle 108 is located adjacent funneling area 84 and directs an air stream towards elements 68 as they move through the funneling area. Additionally, the air stream will dislodge a plastic bottle or an oversized container from an element 68 as the bottle or container is carried past nozzle 108.

Plastic bottles are generally longer and/or have a greater diameter than metal containers. A plastic container will not conformally fit into an element 68 and will therefore be blown off of the element by the air stream.

The load control means and the ferrous-metal and overweight container rejection means comprise what is referred to herein as unacceptable container rejection means. A container which is still retained in an element 68 once the element has passed flap 88 is deemed to be an acceptable container.

A container counter, or counter means, 110 is located adjacent the upper end of guide 78 and includes a light source 112 mounted on a bracket 114 and a photo, or electric eye, sensor 116 mounted on another bracket 118. When a beam of light from source 112 is interrupted by the passage of a container between source 112 and sensor 116, a counting signal is transmitted to a control means, which will be described later herein.

Container ejector means, or ejector, 120 is provided to eject a stuck container from an element 68. Elements 68 may become sticky as partially filled containers, the contents of which are generally high in sugar, disgorge their contents while transisting the machine. In the preferred embodiment, ejector 120 includes a wire 124 which is arranged between brackets 126 and 128 and which passes through slots 72 in elements 68 as they move along guide 78.

A container which has been passed beyond flap 88 drops off the other end 78*b* of guide 78 at off load station 122 into a crusher, or container volume reduction means, 130. Crusher 130 includes a drive motor 132, a gear reduction unit 134 and a crushing chamber 136. Crushing chamber 136 includes side plates 138 and a reciprocating crushing plate 140. A fixed crushing plate 142 is located between side plates 138. Plate 142 is adjustable by means of a shaft 144, which is affixed to plate 142, and passes through a bracket 146 where it is secured by a nut or other suitable fastening means 148. Plate 142 may be adjusted to control the density of a crushed container, allowing an opertor to control the flatness of a crushed container. A setting may be selected which will cause crusher 130 to substantially flatten a container, or, settings may be selected which will cause the crusher to flatten a container to a thickness of between $\frac{1}{4}$ and $\frac{3}{4}$ inch.

Plate 140 is tapered, from top to bottom, allowing a gap between the edge of plate 140 and side plates 138. The gap is narrow at the top of crushing chamber 136 and widens, on each side of the chamber, towards the base of plate 140. This configuration has been demonstrated to provide a significant decrease in the frequency of crushed containers which deform about the edges of plate 140, thereby jamming the crusher.

Reciprocating plate 140 is driven by a crusher arm 150 which is mounted on an eccentric cam 152. Cam 152 is secured to shaft 154. Shaft 154 is mounted in block bearings 156. A shock absorbing coupling 158 connects shaft 154 to a gear reduction output shaft 159, which is driven by gear reduction unit 134. As shaft 154 is caused to rotate by motor 132, eccentric 152 causes crusher arm 150 and reciprocating crushing plate 140 to oscillate, thereby crushing containers which have dropped into crushing chamber 136 through off-load station 122. Crusher 130 operates through approximately one crushing cycle as each element 68 passes off-load station 122.

Control means are provided to coordinate machine operating cycles, and in the preferred embodiment, are located in control boxes 160, 162, 164 and 165 (box 165 is located behind control panel 20). A microprocessor 166 is contained in box 160 and is used to coordinate machine operations. The remaining boxes contain power-supply distribution components. A receipt printer 24a and a coupon printer or dispenser 26a are located in box 165 behind control panel 20. Printers 24a and 26a comprise what is referred to herein as receipt printing means.

Motion sensor means includes a motion sensor 168 and a motor 66. Motion sensor 168 includes a light source 170, which is mounted on panel 60 adjacent frame 58, and a detector 172, which is located on the other side of frame 58, opposite source 170. Frame 58 has plural bores 174 formed therein. Light emanating from source 170 is sensed by detector 172 as a bore 174 allows passage of light through frame 58. When detector 172 senses light from source 170, it transmits an in-motion signal to the control means. Alternately, a reflected light beam may be used to generate the in-motion signal. Back EMF from motor 66 may also be monitored by the control means to detect stoppage or slowing of wheel 58.

A sensor/lock 176 is provided for door 14. An open-door sensor (not shown) is provided for door 18. The door sensor/locks are operable to prevent operation of the machine if either door 14 or door 18 is opened. Sensor/lock 176 is further operable to prevent opening door 14 while the machine is in operation. An interlock 178 is provided to prevent operation of the machine if panel **12*b*** is not properly installed.

OPERATION

Figure 4:
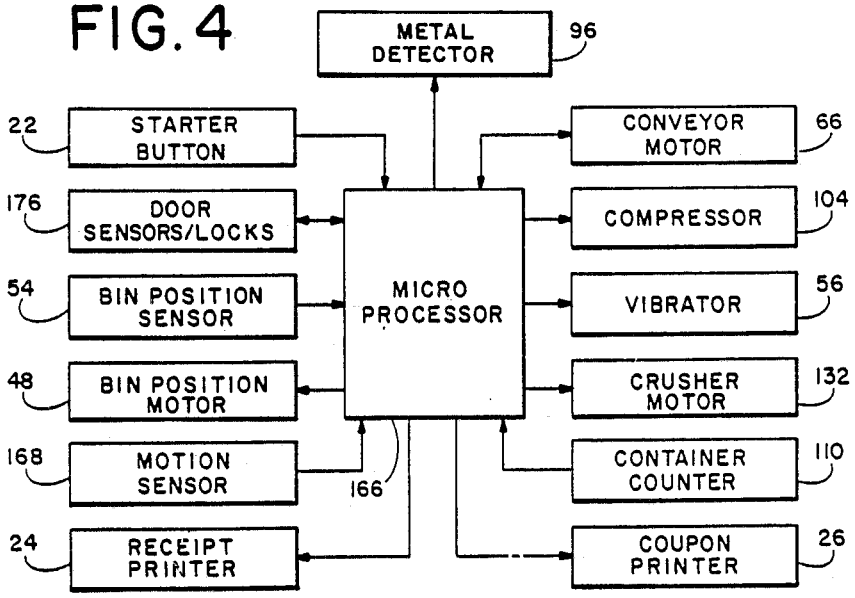
FIG. 4 is a block diagram of control means constructed according to the instant invention.

Turning now to FIG. 4, the relationship between the microprocessor 166 and the other components is depicted. When a customer desires to use the reverse vending machine, the customer first opens door 14 and deposits the containers to be reverse vended into in-feed station 32. So long as door 14 is open, sensor/lock 176 prevents machine operation. Once door 14 is closed, the machine may be operated by depressing button 22, or the machine may be constructed to automatically start upon the closing of door 14.

Microprocessor 166 controls machine operation. The pressing of starter button 22, with doors 14 and 18 properly closed, results in door 14 being locked by sensor/-lock 176. Microprocessor 166 activates vibrator 56, conveyor motor 66, metal detector 96, compressor 104, container counter 110, motion sensor 168 and crusher motor 132. Frame 58 rotates at approximately 7-rpm in the preferred embodiment.

Containers which have been deposited in in-feed station 32 are moved down platform 38 to on-load station 36 by the vibrating action of bin 34. The containers tend to congregate in the lower portion of bin 34 and are received, ideally one at a time, in elements 68. As frame 58 rotates, in a clockwise direction as viewed in FIG. 2, each element carries a container upwards and to the left into funneling area 84 and towards off-load station 122.

If more than one container is received in an element, one or both of the container so received will be rejected from the element by the air blast exiting nozzle 108. A typical empty aluminum container weighs approximately two-thirds ounce and is easily blown out of element 68 by the air blast if the container is not properly received in the element. Additionally, in the event that a non-metallic container, such as a plastic bottle, as been deposited in the machine, the air blast from nozzle 108 will eject the plastic container from element 68. The raised end plates of element 68 such as plate **68*b*, insures that a plastic container, if such is present, will protrude beyond the edge of element 68 and will be placed in the direct stream of the air blast from nozzle 108**.

As a container passes area 84, it arrives at a location at about the 10 o'clock position of frame 58 where ferrous-metal can reject means 100 is located. If a ferrous-metal (tin or steel) can has been placed in the machine, detector 96 will activate solenoid 94, which deforms flap 88 and allows the container to drop through the flap and return to bin 34.

In the preferred embodiment, flap 88 is constructed and adjusted to deform if a container weighing more than 2 ounces passes over the flap. Should a container which is heavier than 2 ounces or which still contains an unacceptable amount of content be deposited in the machine, the additional weight will cause flap 88 to flex and the overweight container will drop through flap 88 into bin 34.

A container which has successfully passed nozzle 108 and flap 88 will break a light beam, generated by light source 112, thereby registering the passage of an acceptable container through the machine. A counting signal is transmitted from counter 10 to microprocessor 166. The container, having reached off-load station 122, drops off end **78*b* of guide 78 into crusher 130. After the container passes through crusher 130, where its volume is appreciably reduced, it exits the base of crusher 130 down a chute 180 and is received in a processed container receptacle 182. Microprocessor 166** retains a count of processed, acceptable containers for future use and for generating a receipt for the customer at the end of each operating cycle.

As the operating cycle continues, unacceptable containers, such as ferrous-metal, glass or plastic containers, continue to be picked up by elements 68 and these same containers continue to be rejected by the unacceptable container reject means. After a predetermined amount of time, as set in microprocessor 166, has passed without the beam from light source 112 being broken by an acceptable container, microprocessor 166 activates bin position motor 48, thereby shifting bin 34 from its operating position to its transfer position. Any containers which remain in bin 34 as the bin is shifted to its transfer position drop into an unacceptable container receptacle 184 which is located below bin 34. Bin position sensor 54 transmits a signal to the microprocessor once the bin has reached its full transfer position whereupon motor 48 is caused to reverse, shifting bin 34 back to its operating position. Once bin 34 has returned to its operating position, microprocessor 166 turns off motor 48, vibrator 56, motor 66, metal detector 96, compressor 104, motor 132 and the various light sources in the machine. Additionally, sensor/lock 176 is unlocked, allowing door 14 to be opened for the next deposit of containers by a customer. Microprocessor 166 then causes receipt printer **24*a* to print a receipt, which exits through receipt output 24, to indicate the number of acceptable containers which the customer has placed in the machine. Additionally, if coupon dispenser 26*a* is in use, a coupon will be dispensed through coupon output 26**.

Bin 34 may be stabilized by the provision of a cable and pulley system (not shown) which is located beneath bin 34 and is attached to bin 34 and to frame 30. The cable and pulley system may be provided to stabilize bin 34 and to insure that the bin does not twist during shifting between its operating and transfer positions.

Should frame 58 stop at any time during the processing cycle, motor 66 and/or detector 172 would not transmit an in-motion signal to microprocessor 166 in the time interval required for microprocessor 166 to receive such a signal. The most likely cause of frame 58 stopping would be a jam in funneling area 84. Such a condition results in microprocessor 166 sending a signal to conveyor motor 66 which causes the motor to reverse direction, thereby causing frame 58 to rotate in a counter clockwise direction, presumably clearing the jam in the funneling area. After a predetermined amount of time, generally enough time for ¼ to ½ revolution of frame 58, motor 66 is stopped and then started in its normal, predetermined operating direction, causing frame 58 to again turn in a clockwise direction. The machine will cycle 5 times before an out-of-service light on panel 17 is illuminated and the machine shut down.

Referring now to FIG. 1, a coupon output 26 is connected adjacent coupon dispenser 26*a*, which is located in box 165 on the backside of control panel 20. Coupon dispenser 26*a* may be used by the machine operator to provide cents-off or other promotional coupons as an added incentive to his customers to return recyclable containers to the outlet. In those localities which permit such activities, the coupon output might be used to dispense gaming tickets as an incentive to customers to return containers. Preprinted coupons or gaming tickets may be dispensed, or the coupons or tickets may be printed by the machine.

To facilitate access to the inner workings of machine 10, panel 74 is hinged and may be lowered to allow access to the separator/conveyor chamber. Guide panel 80 may be completely removed, with its components in tact, to facilitate cleaning and repair of the devices thereon. Additionally, door 18 is of sufficient size to allow removal of receptacle 182, after which, receptacle 184 may be moved to the adjacent chamber and then removed from the machine.

The microprocessor may be programmed to keep track of the total number of containers counted over a time period to provide the operator with accounting information and machine usage history.

A machine has thus been disclosed which will efficiently dispose of acceptable containers. The machine will automatically count and crush recyclable beverage containers while simultaneously rejecting and disposing of containers which are not acceptable for recycling. The machine will then print a receipt representative of the number of acceptable containers deposited in the machine. The machine does not require a great deal of human labor and is easy and cost effective to manufacture.

Although a preferred embodiment of a reverse vending machine has been disclosed, it should be appreciated that variations and modifications may be made thereto without departing from the spirit of the invention.

It is claimed and desired to be secured by Letters Patent:

1. A reverse vending machine for separating, counting and crushing beverage containers of a predetermined size range comprising:

an in-feed station for receiving multiple, disarrayed containers;

an on-load station;

an off-load station;

an in-feed conveyor operable to transport multiple, disarrayed containers from said in-feed station to said on-load station said in-feed conveyor being operable at the end of a processing cycle to shift between an operating position and a transfer position;

separator/conveyor means for separating, singularly, a container from the disarrayed containers, and transporting a container so separated from said on-load station to said off-load station, including container retention means there-adjacent for holding the containers therein;

unacceptable container rejection means for rejecting an unacceptable container, including port means on said container retention means for allowing passage of unacceptable containers therethrough;

a non-processed container receptacle for receiving a non-processed container remaining on said in-feed conveyor at the end of said processing cycle when said in-feed conveyor is in said transfer postion;

counter means for counting a number of acceptable containers passing between said on-load station and said offload station;

container volume reduction means located adjacent said off-load station for crushing containers;

receipt printing means for print a receipt indicating the number of containers counted by said counter means; and control means for coordinating machine operating cycles.

2. The machine of claim 1 wherein said separator/-conveyor means includes plural container carrying elements for carrying containers endo, each element being of a size to preclude carrying of more than one container.

3. The machine of claim 2 wherein said elements are mounted on a circular frame, and said frame is mounted for rotation adjacent said on-load station and said off-load station.

4. The machine of claim 3 wherein said elements are semi-cylindrical shaped and substantially conformal with such a container.

5. The machine of claim 3 wherein said control means controls the direction of rotation of said frame, and which further includes motion sensor means for detecting stoppage of rotation of said frame and for generating a signal to said control means in the event of such stoppage; and wherein said control means causes said frame to rotate in a predetermined direction until receipt of said signal indicating stoppage, whereupon said control means causes said frame to counter-rotate for a predetermined time, after which said control means causes said frame to rotate in said predetermined direction.

6. The machine of claim 2 which further includes load-control means for removing containers in excess of unity from individual of said elements.

7. The machine of claim 6 wherein said load-control means includes means for providing a high-pressure fluid stream, and means for directing said stream towards said elements.

8. The machine of claim 7 wherein said rejection means includes means mounted on said elements to preclude transport of a plastic container beyond said load control means.

9. The machine of claim 1 wherein said retention means includes resilient guide means and said port means includes a flexible flap in said guide means.

10. The machine of claim 9 wherein said flap is operable, with an unacceptable container in excess of a predetermined weight, to deform thereby to allow passage of the unacceptable container past said flap.

11. The machine of claim 9 which further includes a ferrous-metal can reject means adjacent said port means operable with an unacceptable ferrous-metal can to remove said ferrous-metal can from said separator/conveyor means.

12. The machine of claim 11 wherein said ferrous-metal can reject means includes a metal detector mounted adjacent said guide means operable to deform said flap, thereby to allow passage of a ferrous-metal container through said flap.

13. The machine of claim 1 wherein said counter means includes an electric eye sensor operable to sense passage of a container carried on said separator/conveyor means, and further operable to transmit a counting signal to said control means upon passage of every acceptable container, said control means being operable to detect the absence of such a counting signal for a predetermined time period, thereafter being operable to end the processing cycle.

14. The machine of claim 1 wherein said container volume reduction means includes a powered container crusher having a crushing chamber with an open top, said crusher having a fixed crushing plate and a reciprocating crushing plate forming opposed, spaced-apart sides of said chamber, said plates having substantially similar widths at their top margins and said reciprocating plate tapering to a width less than that of said fixed plate at their respective bottom margins.

* * * * *